US009459044B1

(12) United States Patent
Haddock et al.

(10) Patent No.: US 9,459,044 B1
(45) Date of Patent: Oct. 4, 2016

(54) FREEZE DRYING METHODS AND APPARATUSES

(71) Applicant: Harvest Right, LLC, North Salt Lake, UT (US)

(72) Inventors: Rex C Haddock, Bountiful, UT (US); D Barry McCann, Bountiful, UT (US)

(73) Assignee: HARVEST RIGHT, LLC, North Salt Lake, UT (US)

( * ) Notice: Subject to any disclaimer, the term of this patent is extended or adjusted under 35 U.S.C. 154(b) by 622 days.

(21) Appl. No.: 13/841,251

(22) Filed: Mar. 15, 2013

(51) Int. Cl.
*F26B 5/06* (2006.01)
*F26B 3/00* (2006.01)

(52) U.S. Cl.
CPC ..... *F26B 3/00* (2013.01)

(58) Field of Classification Search
CPC ..... F26B 5/041; F26B 5/04; F26B 5/044; F26B 5/06; A23L 3/44
USPC ..... 34/284–290, 292, 407, 408, 467–471, 34/75
See application file for complete search history.

(56) References Cited

U.S. PATENT DOCUMENTS 2,528,476 A * 10/1950 Roos et al. ..... 34/292
4,521,975 A * 6/1985 Bailey ..... B01L 3/5085 34/285
4,543,734 A 10/1985 Smith
4,561,191 A 12/1985 Parkinson
4,780,964 A * 11/1988 Thompson, Sr. ..... F26B 5/06 34/292
4,823,478 A 4/1989 Thompson, Sr.
4,978,467 A 12/1990 Shankland et al.
5,822,882 A 10/1998 Anger
6,122,836 A 9/2000 Tenedini et al.
6,226,887 B1 5/2001 Tenedini et al.
6,327,866 B1 * 12/2001 Novak et al. ..... 62/114
6,481,223 B2 11/2002 Flynn et al.
6,564,471 B1 5/2003 Sutherland et al.
6,669,689 B2 * 12/2003 Lehmann et al. ..... 606/22
6,971,187 B1 12/2005 Pikal et al.
2005/0086950 A1 * 4/2005 Khatri ..... 62/114
2010/0018073 A1 1/2010 Fissore et al.
2014/0069607 A1 * 3/2014 Crook ..... 165/63

* cited by examiner

*Primary Examiner* — Kenneth Rinehart
*Assistant Examiner* — John McCormack
(74) *Attorney, Agent, or Firm* — Parsons, Behle & Latimer

(57) ABSTRACT

A freeze drying method includes decreasing pressure to a first vacuum pressure and, as a result of reaching the first pressure, a control system automatically activating a heater. The method includes sublimating solid water, increasing pressure to a second vacuum pressure greater than the first pressure, and, as a result of reaching the second pressure, the control system automatically deactivating the heater. As a result, a decrease in pressure, pressure-activated heater activation, material heating, water sublimation, and increase in pressure occur, accomplishing pressure-activated heater cycling. Another freeze drying method includes decreasing a temperature in a chamber to −50° F. or less using a refrigeration system with single-stage compression and sublimating solid water at a vacuum pressure. A freeze drying apparatus includes a chamber, a vacuum pump, a heater, and a control system programmed with instructions operable to accomplish pressure-activated heater cycling.

19 Claims, 9 Drawing Sheets

FREEZE DRYING METHODS AND APPARATUSES

TECHNICAL FIELD

The embodiments pertain to freeze drying methods and apparatuses. Examples may be methods that include pressure-activated heater cycling, methods that include establishing a temperature down to −35° F. or less, such as −50° F. or less, in a chamber using a refrigeration system with single-stage compression, or combinations thereof. Examples also include apparatuses configured to implement such methods.

BACKGROUND

As a food preservation method, freeze drying has several benefits over others. To maintain fresh flavor and nutritional value, frozen food requires uniform, below freezing storage conditions. High-temperature processing to produce dehydrated and canned foods degrades the flavor, texture, and nutritional content, despite producing a product that may be stored without refrigeration. Freeze drying preserves freshness, color, and aroma similar to frozen food without relying on refrigeration, like canned or dehydrated food. Freeze drying is intended to remove water from food, but not the flavor, color, texture or nutritional value.

Freeze dried foods may maintain their original shape and texture instead of shrinking or shriveling as in high-temperature processing for dehydration. Moisture channels and food fibers may remain intact so that, after just adding water, details of the fresh food return. Freeze dried foods may be light weight with at least 96% of their water removed and may be stored at room temperature without deterioration. Since freeze drying removes oxygen as well as water, foods packaged inside an oxygen barrier with an oxygen scavenger material may be stored long term. Individual items as well as prepared meals may be freeze dried.

Freeze drying, or lyophilization, involves freezing a material and then placing it under vacuum in a chamber at temperature and pressure conditions below the triple point of water (273.16 Kelvin, 611.73 Pascals), allowing frozen water in the material to sublimate to a gas, since it is below the triple point. As the term is used herein, the "triple point" refers to the temperature and pressure conditions at which solid, liquid, and gas phases are in equilibrium. Below the triple point of water, solid water does not transition to a liquid phase before becoming a gas. The solid to gas phase transition is referred to as "sublimation."

A vacuum pump provides the vacuum pressure and an evaporator of a refrigeration system provides a surface colder than the material temperature whereon the gaseous water may condense and freeze to avoid moisture collecting in the vacuum pump. "Vacuum pressure," as used herein, is an absolute pressure, unless otherwise indicated, that is below atmospheric pressure. Accordingly, a perfect vacuum exhibits zero pressure units (e.g., 0 milliTorr) of vacuum pressure and a pressure just below atmospheric pressure exhibits a higher number of pressure units (e.g., 759 milliTorr) of vacuum pressure with a positive value.

In known methods, chamber cooling maintains a constant chamber temperature. To accelerate sublimation, known methods heat a tray on which the material rests and the heating raises chamber vacuum pressure. Such known methods use process controls for cooling and vacuum pumping to maintain constant temperature and pressure. Vacuum pressure rises due to a water phase change from solid to gas and due to tray heating. The heating time, tray temperature, and ramping of tray temperature are material specific and are determined through trial and error to provide proper freeze drying for various materials according to designated process conditions. Examples of such known methods are described in U.S. Pat. Nos. 6,226,887 and 6,122,836 to Tenedini, wherein vacuum pumps are cycled off and on to regulate pressure.

Known freeze dryers incorporate many process control features to accomplish freeze drying, as described in U.S. Pat. Nos. 4,823,478 and 4,780,964 to Thompson. Features may include a cascading, multi-stage compression refrigeration system to achieve temperatures below −35° F., separate chambers for accumulating solid water from the sublimation process, temperature controllers programmed for a specific product, thermocouples to provide information to the temperature controller, and a programmable controller to receive instructions from an operator. An operator has a significant understanding of the freeze drying process in order to adequately set up the process controls. Solid state relays, switches, and digital and analog devices allow a desired "recipe" to control the freeze drying process.

A desire exists in freeze drying to control the rate of sublimation for a particular material. Heating the material too much in the vacuum chamber may thaw the material to a liquid or may generate too much gaseous water, overwhelming the vacuum pump and increasing the pressure too high for optimum moisture removal. For a given material, how it is prepared, its size, and its shape affect a given recipe and adds complication to the process. Accordingly, a desire exists to simplify freeze drying by reducing the effort involved in trial and error determination of freeze drying conditions and parameters.

BRIEF DESCRIPTION OF THE DRAWINGS

Some embodiments are described below with reference to the following accompanying drawings.

DETAILED DESCRIPTION

Figure 1:
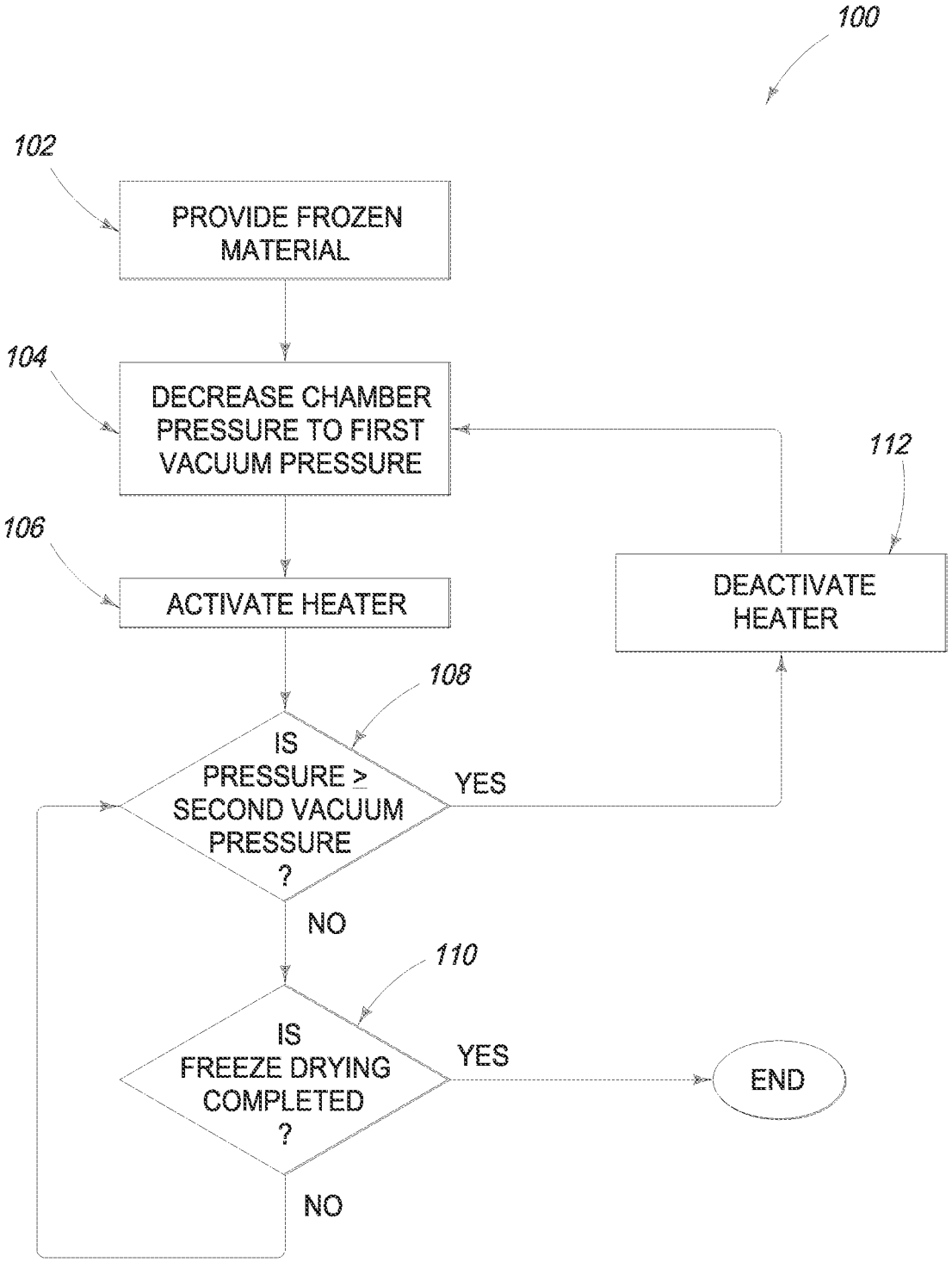
FIGS. 1 and 2 are flow diagrams showing freeze drying methods.

Observation indicates that pressure-activated heater cycling allows a reduction in the effort associated with freeze drying. Indeed, automated freeze drying is described herein without trial and error experimentation to determine varying process conditions for different materials, such as different types of food. Also, multiple types of different material may be freeze dried at the same time, even though known methods would establish different recipes for freeze drying each type. The methods and apparatuses are adapted for incorporation into a consumer-oriented product that allows one-button startup followed by automatic completion without operator configuration for different materials.

The methods and apparatuses herein are discussed in the context of freeze drying food as well as medical (such as, biological samples), pharmaceutical, and other uses, such as recovery of water-damaged articles. Also, although water is removed in the freeze drying methods herein, it will be understood by those of ordinary skill how to adapt the teachings herein to removal of other liquids.

It was discovered that pressure ranges may be established that are material independent for all materials tested thus far and allow automation of freeze drying without material specific testing. Freeze drying process controls need not include temperature sensors. Even so, a temperature control may be used on trays holding material to be freeze dried to reduce denaturing of the material at greater than 125° F. Upper and lower limits of the pressure ranges may vary depending on equipment configuration, such as vacuum pump flow capacity, but may be set for a certain configuration without regard to specific materials being freeze dried. In other methods and apparatuses described herein, upper and lower pressure limits may vary dynamically during freeze drying depending on cycle length, which is related to the rate of water removal, to reduce total process time.

A refrigeration system may be used for the freeze drying method with a single-stage compressor that achieves a chamber temperature of −35° F. or less, such as −50° F. or less. While some materials might be freeze dried at a chamber temperature of about −35° F., freeze drying at −50° F. allows greater process reliability and flexibility for a wider variety of materials. Known apparatuses' refrigeration systems for freeze drying are unable to reach −35° F. or −50° F. with a single-stage compressor and, instead, use multiple stages. Some of the features used in the apparatuses and methods herein that enable reaching −50° F. include the refrigerant, a lengthy capillary tube in the refrigeration system, and closed-cell insulation around the vacuum chamber. It will be appreciated that features that enable reaching −50° F. also enable reaching −35° F., which uses less cooling. Accordingly, an operator may elect to implement any of the apparatuses and methods herein at −35° F. or less as an alternative to −50° F. or less, if appropriate for a selected material.

FIG. 1 is a flow diagram of a freeze drying method 100 according to one embodiment. Action 102 in method 100 includes providing frozen material. The frozen material may contain solid water that is intended for sublimation from the material to accomplish freeze drying. Configurations described herein allow a material to be frozen in the vacuum chamber itself. As an alternative, a material might be frozen previously and placed in a vacuum chamber. Action 104 in method 100 includes decreasing chamber pressure to a first vacuum pressure followed by activation of a heater in action 106. Under appropriate conditions, as described further herein, solid water in the frozen material may sublimate to produce gaseous water.

Given the addition of heat to the material from the activated heater and the increase in gaseous water from the sublimating solid water, pressure in the vacuum chamber may increase. Accordingly, method 100 includes determining whether pressure is greater than or equal to a second vacuum pressure in decision 108. If pressure is greater than or equal to the second pressure, then the heater is deactivated in action 112 and the decrease in pressure and heater activation of respective actions 104 and 106 are repeated. It will be appreciated that pressure in the chamber may rise and fall according to the pressure-activated heater cycling in method 100.

According to decision 108, if pressure is less than the second vacuum pressure, then a determination is made in decision 110 whether freeze drying is completed. If freeze drying is not completed, the heater remains activated and pressure continues to be monitored according to decision 108 until pressure reaches or exceeds the second pressure. After repeated heating, insufficient solid water remains in the frozen material to produce a pressure rise that reaches the second pressure. Accordingly, failure to reach the second pressure after a designated time during which the heater is activated, may indicate near completion of freeze drying. Thereafter, method 100 ends and freeze dried material may be removed.

Figure 2:
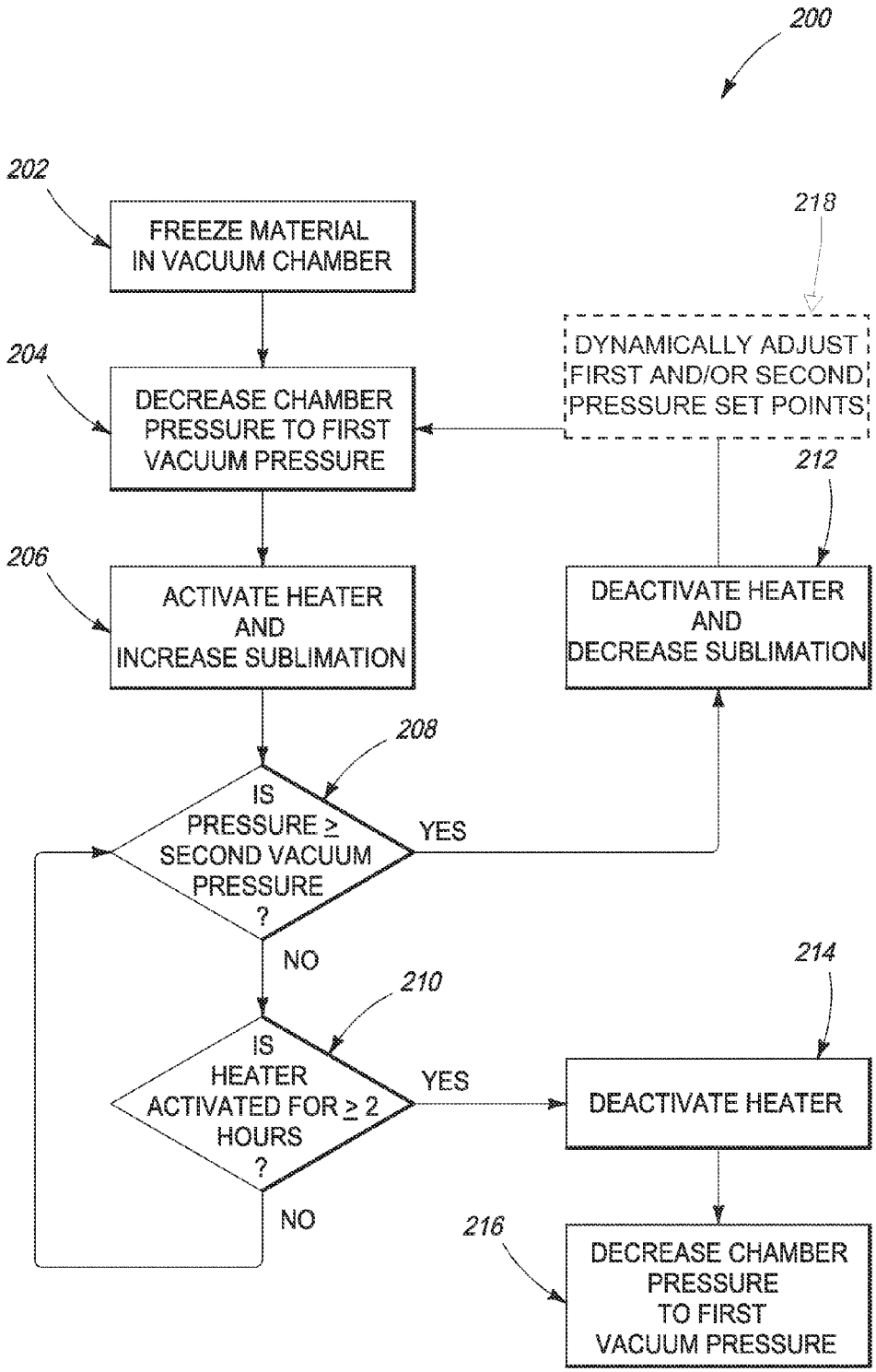

FIG. 2 shows a flow diagram of a freeze drying method 200 according to another embodiment. Method 200 includes freezing material in a vacuum chamber to produce solid water in the material. Chamber pressure is decreased in action 204 to a first vacuum pressure. Activation of the heater in action 206 increases sublimation of the solid water until pressure is greater than or equal to the second vacuum pressure, as determined in decision 208. The heater is deactivated in action 212 to decrease sublimation, and pressure returns to the first pressure. Repetition of the decrease in pressure and heater activation produces pressure-activated heater cycling.

Decision 210 determines whether the heater was last activated by pressure-activation for at least two hours without reaching the second pressure. The time of at least about two hours was determined through observation that a heater cycle often lasts about 15 to 30 minutes. Cycle length may depend on properties of the material itself and/or on how many cycles have already occurred. Observation also indicated that about 10 to 25 cycles, for example, 12-16 cycles, occur before freeze drying is complete, depending on water content of the material and propensity of the material to release sublimated water. A heater cycle lasting much longer than previously occurred also gives some indication that freeze drying is approaching completion.

A run time of at least two hours for the heater following pressure-activation is much longer than observed for many materials. However, to be certain freeze drying is complete for a wider variety of materials, a run time exceeding at least 6 hours may be used for the run time. Such a method for determining completion of freeze drying may be contrasted with the method described in U.S. Pat. No. 4,780,964 to Thompson, which instead relies on monitoring of material temperature.

Action 218 involves dynamically adjusting first and/or second pressure set points before pressure-activated heater activation occurs again. Action 218 is shown in dashed lines to indicate it may be implemented or not implemented. Accordingly, method 200 may include selecting the first and second pressures in a control system and maintaining them during the pressure-activated heater cycling. Instead, method 200 may include selecting the first and second pressures in the control system and dynamically adjusting them during the pressure-activated heater cycling. The adjustment may be based at least on a heater run time.

Dynamically adjusting the first and second pressures may include decreasing a set point for the first pressure and increasing a set point for the second pressure. Accordingly, with successive pressure-activated heater cycles, the first pressure becomes lower and the second pressure becomes higher. Increasing a difference between the first and second pressures often increases heater run time since it allows a greater pressure increase above the first pressure. A desired heater run time may be from about 30 to about 60 minutes. Consequently, if a heater run time is too short before being deactivated by reaching the second pressure, a longer run time could be implemented to allow more sublimation.

Implementing the longer run time may occur dynamically by decreasing a set point for the first pressure and increasing a set point for the second pressure based on an immediately preceding run time.

Alternatively, dynamically adjusting the first and second pressures may include maintaining a difference between the first and second pressures while decreasing both a set point for the first pressure and a set point for the second pressure. Or, the dynamic adjustment may include maintaining the difference while increasing both a set point for the first pressure and a set point for the second pressure. Even though pressure difference is maintained, decreasing both the set points tends to decrease heater run time since flow rate from sublimation often increases at lower pressures. Similarly, increasing both the set points tends to increase heater run time since flow rate from sublimation often decreases at higher pressures. With the dynamic adjustment features described herein, variation in water content, dimensions, and other properties of material may be accounted for automatically during pressure-activated heater cycling and total process time reduced.

Independent of the pressure-activated heater cycling, heater function might be controlled to reduce the likelihood of degrading frozen material in contact with heated surfaces. For example, heater temperature might be maintained below 125° F. to avoid denaturing food. Heater temperature control might also involve deactivating and activating the heater independent of the deactivation for the purpose of decreasing pressure. However, run time for the purpose of dynamically adjusting pressure or determining freeze drying completion may be measured from the last pressure-activated heater activation. Since heater temperature control intends only to avoid degrading frozen material, any pressure drop will likely be brief and exhibit a limited influence on pressure compared to pressure-activated heater deactivation. As a result, transitory pressure drops caused by temperature-activated heater cycling may be ignored in tracking heater run time for the purpose of dynamically adjusting pressure or determining freeze drying completion.

Method 200 may be ended by deactivating the heater in action 214 followed by decreasing chamber pressure to the first chamber pressure or less in action 216. Leaving the heater deactivated at the first pressure or less and turning off the vacuum pump at the first pressure or less allows the freeze dried material to be maintained under refrigerated vacuum until removed. Deactivating the heater avoids melting accumulated solid water in the vacuum chamber and hydrating the freeze dried material. Reducing chamber pressure to the first pressure or less avoids reintroduction of oxygen to the freeze dried material.

Figure 3A:
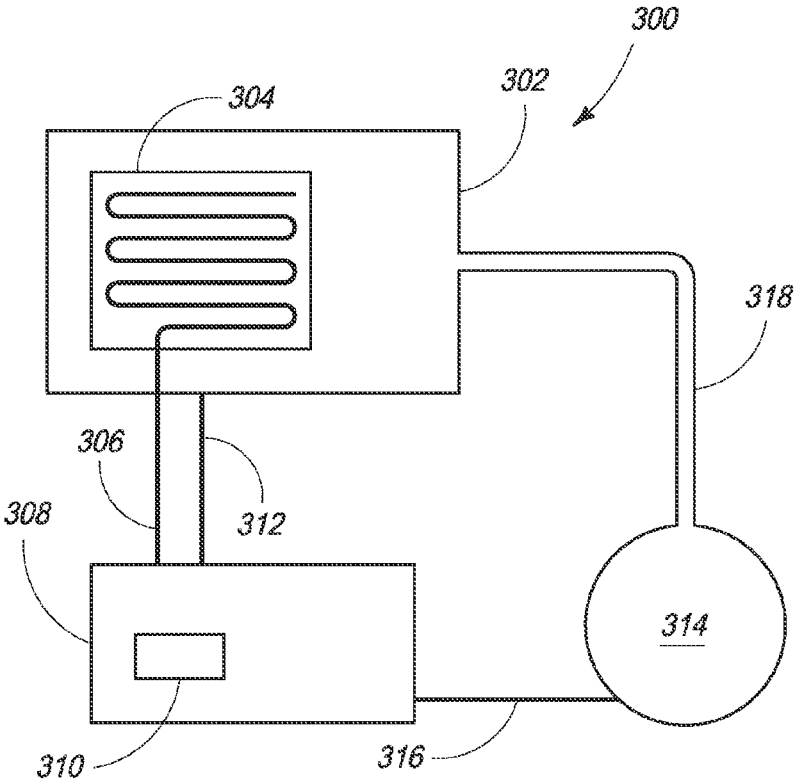
FIGS. 3A and 3B are process diagrams showing two embodiments of a vacuum system.

FIG. 3A is a process diagram showing a vacuum system 300 according to one embodiment. Vacuum system 300 includes a chamber 302 in which a vacuum may be established using a vacuum pump 314 connected thereto through a vacuum line 318. Operation of vacuum pump 314 may be conducted by a controller 308 connected to vacuum pump 314 by sending a pump signal 316. Controller 308 includes a processor 310 which may act upon stored instructions for activating vacuum pump 314 according to selected process conditions. A pressure signal 312 may be received by controller 308 reflecting pressure inside chamber 302.

A heater 304 inside chamber 302 and may be activated by a heater signal 306 initiated by controller 308. Heater 304, if activated, heats material containing solid water in chamber 302. Vacuum pump 314 may be operable to decrease pressure in chamber 302 to a first vacuum pressure. Controller 308 may be included in a control system configured to automatically activate heater 304 at the first vacuum pressure to allow heating the material without melting the solid water. The control system may also allow sublimating the solid water and automatically deactivating heater 304 at a second vacuum pressure greater than the first vacuum pressure, as indicated by pressure signal 312. As a result, vacuum system 300 may be used to accomplish pressure-activated heater cycling.

Figure 3B:
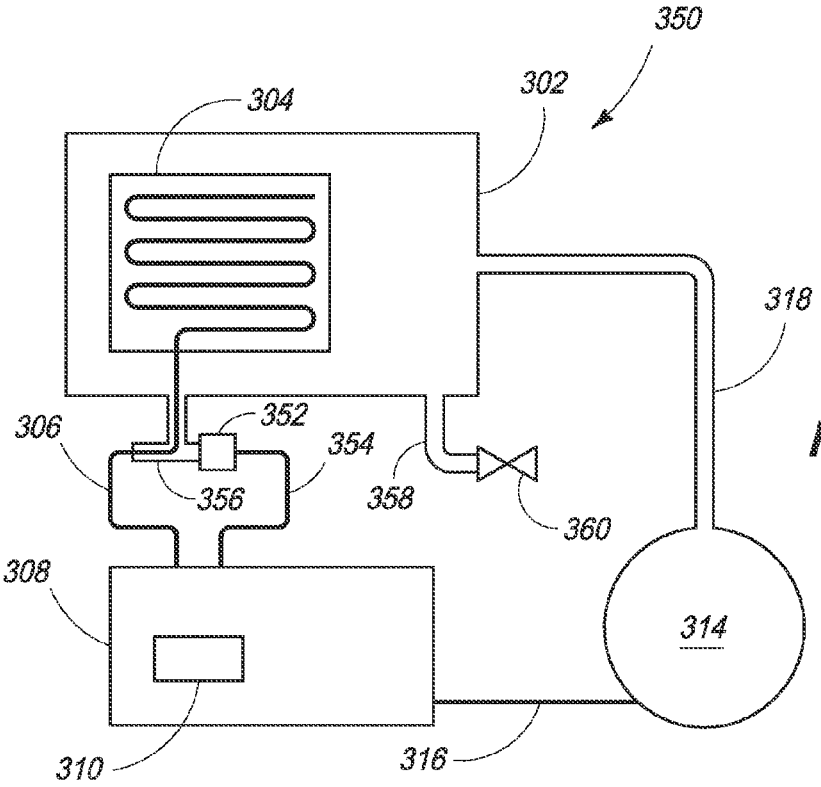

FIG. 3B is a process diagram showing a vacuum system 350 according to another embodiment. It will be appreciated from the following description that vacuum system 350 may also be used to accomplish pressure-activated heater cycling. Vacuum system 350 includes chamber 302, heater 304, controller 308 with processor 310, and vacuum pump 314, as in vacuum system 300. Vacuum pump 314 establishes a vacuum in chamber 302 using vacuum line 318 and is operated by pump signal 316 received from controller 308. Likewise, heater signal 306 operates heater 304.

In addition, a tee 356 is connected to chamber 302, providing a port to run wiring through carrying power and heater signal 306. Tee 356 also accommodates a sensor 352 attached to the tee and operable to measure pressure in chamber 302. A pressure signal 354 from sensor 352 is received by controller 308. Sensor 352 may be at an alternate location, such as inside chamber 302, and may have a wired or wireless connection to controller 308. Also, heater signal 306 and pump signal 316 may be carried by wired or wireless means. Chamber 302 further has attached thereto a drain line 358 for draining collected moisture from chamber 302 and a drain valve 360 to control removal of liquid.

Figure 4A:
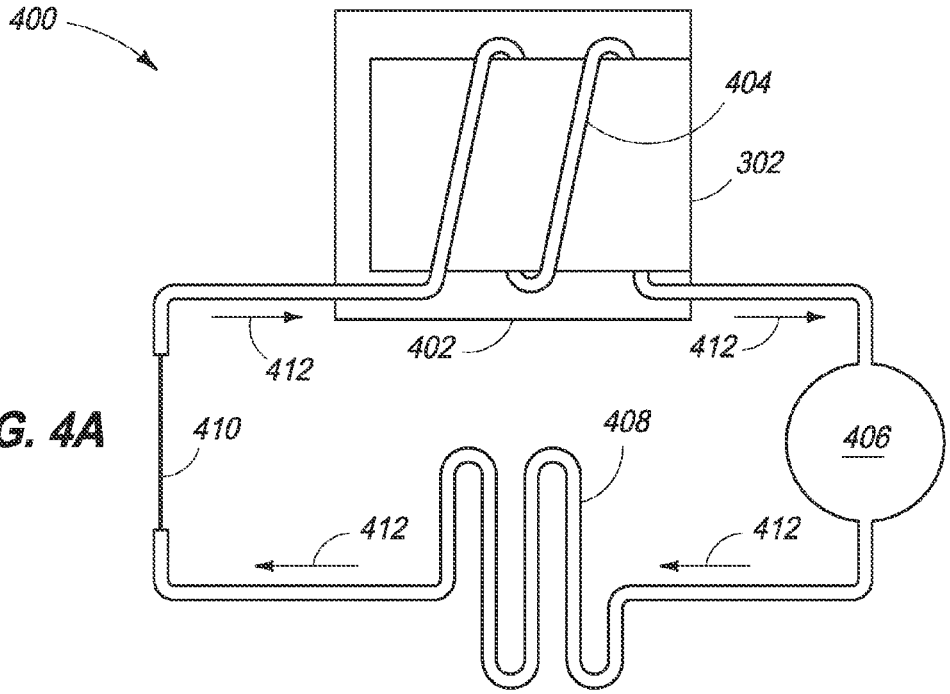
FIGS. 4A and 4B are process diagrams showing two embodiments of a refrigeration system.

FIG. 4A is a process diagram showing a refrigeration system 400 according to one embodiment. Refrigeration system 400 includes an evaporator coil 404 in which a liquid refrigerant evaporates during heat transfer into a gas refrigerant as in a known refrigeration cycle. Evaporated refrigerant flows into a compressor 406 according to a flow direction 412. Compressed refrigerant travels along flow direction 412 from compressor 406 to a condenser coil 408 where heat is removed from refrigerant, which condenses and flows according to flow direction 412 into a capillary tube 410. Although a capillary tube is shown in refrigeration system 400, an alternative pressure expansion device, such as an expansion valve, might be used. A pressure drop that occurs in capillary tube 410, or an alternative expansion device, causes a drop in temperature of the refrigerant, which flows back into evaporator coil 404, completing the refrigeration cycle.

Refrigeration system 400 is associated with chamber 302 also shown in FIGS. 3A and 3B to absorb heat from chamber 302. Insulation 402 may be adhered in contact with an outer surface of a wall of chamber 302 to reduce exposure of the outer surface to ambient air. The reduction in exposure may occur in comparison to no insulation or in comparison to insulation not adhered in contact with the outer surface. Accordingly, a freeze drying method may be implemented in refrigeration system 400 that includes decreasing pressure in chamber 302 to a vacuum pressure, decreasing temperature in chamber 302 to −50° F. or less using refrigeration system 400 with single-stage compression, and sublimating solid water contained in a material in chamber 302. Use of single-stage compression reduces the cost and energy demand of compressor 406 compared to multiple stage compression.

While a variety of refrigerants might be used, a vapor pressure differential between −55° F. and 100° F. of at least 230 pounds per inch$^2$ (psi), such as at least 300 psi, assists in enabling a temperature in chamber 302 of −50° F. with single-stage compression. Also, the refrigerant may exhibit a vapor pressure at −50° F. of at least 14.7 psi absolute to ensure a vapor pressure above atmospheric pressure at a suction line to compressor 406. One example of a suitable refrigerant includes a 50/50 weight percent combination of HFC-32 (difluoromethane) and HFC-125 (pentafluoroethane) sold under the trade name AZ-20 and covered by U.S. Pat. No. 4,978,467. R-410A is known for use in air conditioning applications and exhibits a vapor pressure differential between −55° F. and 100° F. of about 315 psi and a vapor pressure at −50° F. of about 19 psi absolute.

Given the single-stage compression, the selected refrigerant, and expected operating conditions, a design for refrigeration system 400 includes selecting an inside diameter and a length for capillary tube 410 suitable to produce the desired chamber temperature. While a smaller inside diameter affords increased pressure drop, it also produces decreased flow rate and, thus, cooling capacity. A longer length also affords increased pressure drop, accordingly, capillary tube length may be at least 30 inches, such as 30 to 70 inches, and a nominal inside diameter may be at least 0.024 inches. A capillary tube with an inside diameter of 0.032 inches may have a length of 48 inches.

Figure 4B:
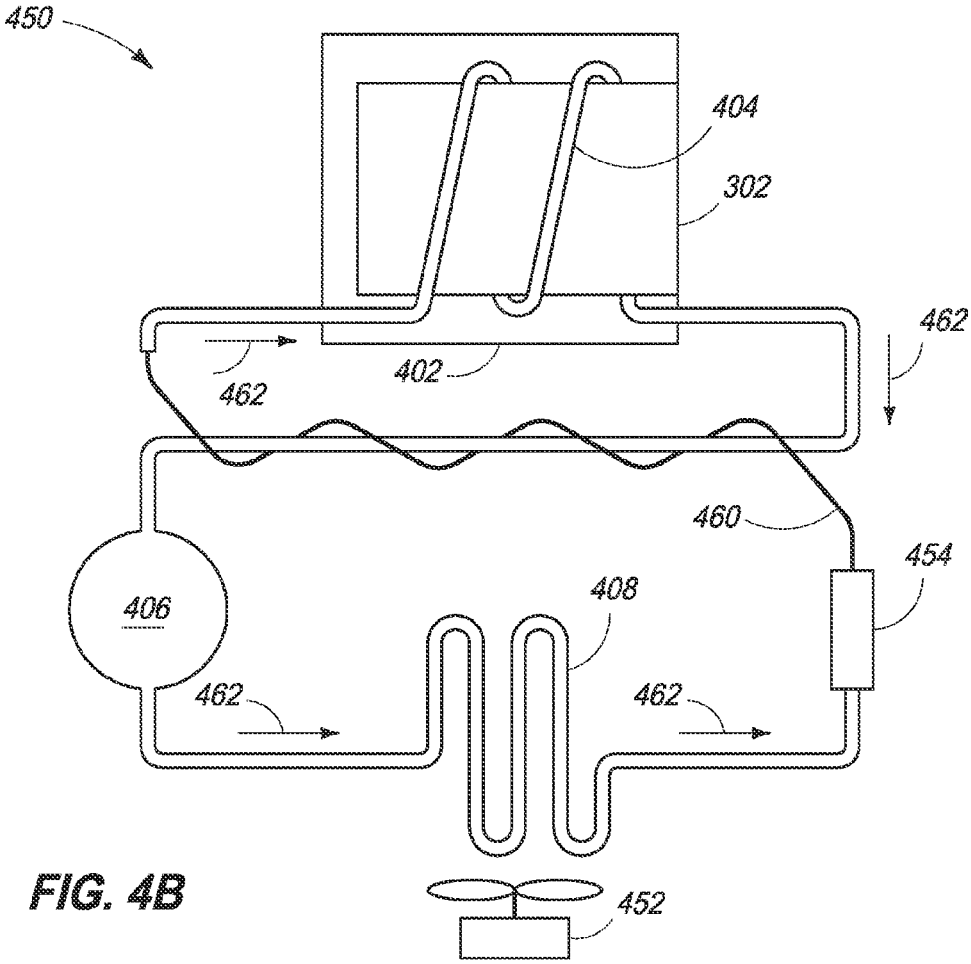

FIG. 4B is a process diagram showing a refrigeration system 450 according to another embodiment. Refrigeration system 450 includes evaporator coil 404 associated with chamber 302 as in FIG. 4A. Refrigeration system 450 also includes compressor 406, condenser coil 408, and insulation 402 around chamber 302. In addition, refrigeration system 450 includes a capillary tube 460 in association with refrigerant flowing along flow direction 462 from evaporator coil 404 to compressor 406. Capillary tube 460 may be wound in contact with refrigerant tubing. The association allows heat exchange from the warm liquid refrigerant in capillary tube 460 to the cold gas refrigerant in evaporator coil 404.

The concurrent flow of refrigerant through capillary tube 460 in heat exchange association with refrigerant from evaporator coil 404 may further cool refrigerant during the pressure drop that occurs in capillary tube 460. The further cooling may additionally contribute to obtaining −50° F. using single-stage compression.

Refrigeration system 450 may also include a fan 452 promoting convective heat loss from condenser coil 408. A dryer filter 454 removes water and/or contaminants from refrigerant to avoid clogging capillary tube 460 or other process complications.

Figure 5:
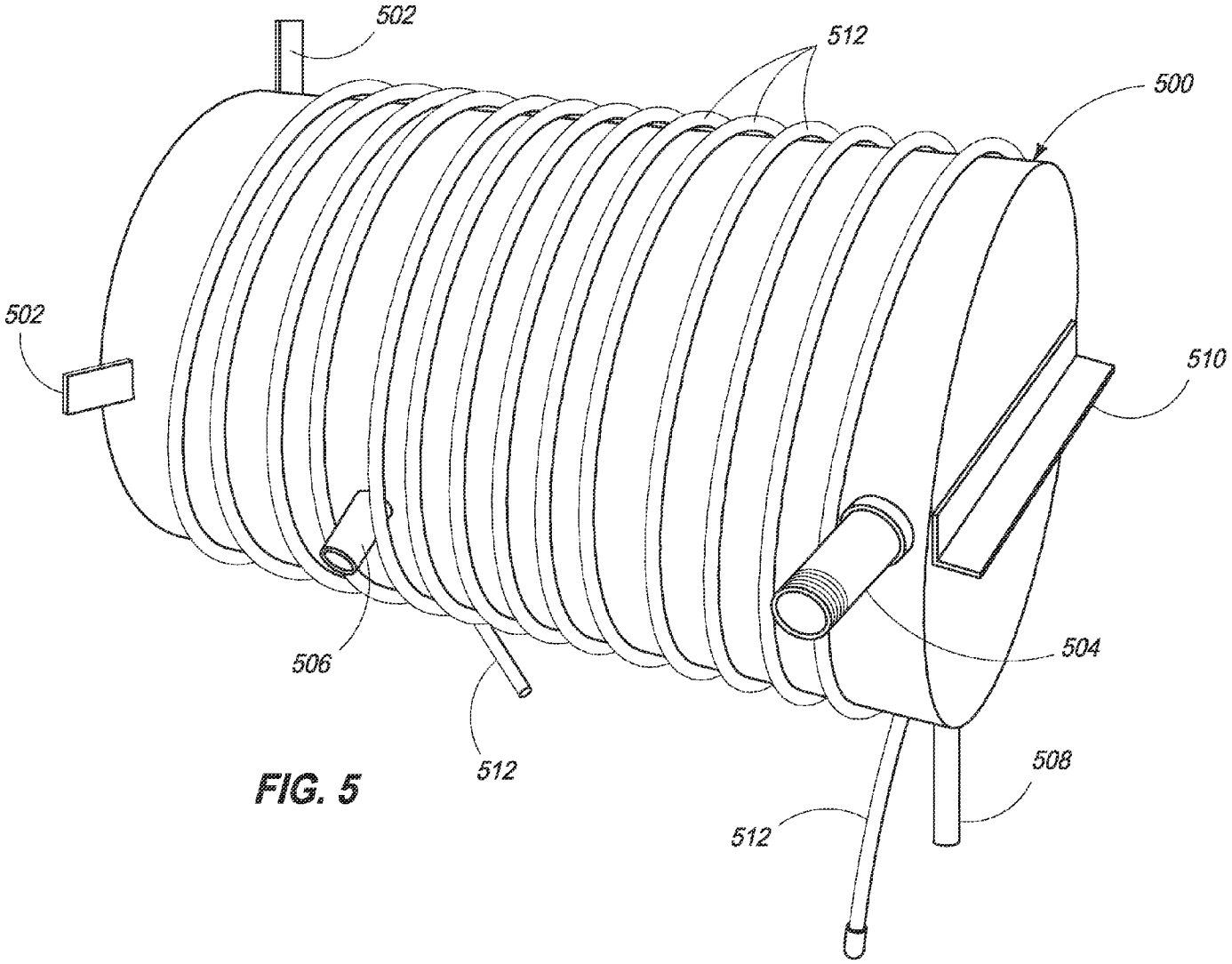
FIGS. 5 and 6 show perspective side and front views of parts of a refrigeration system.
Figure 6:
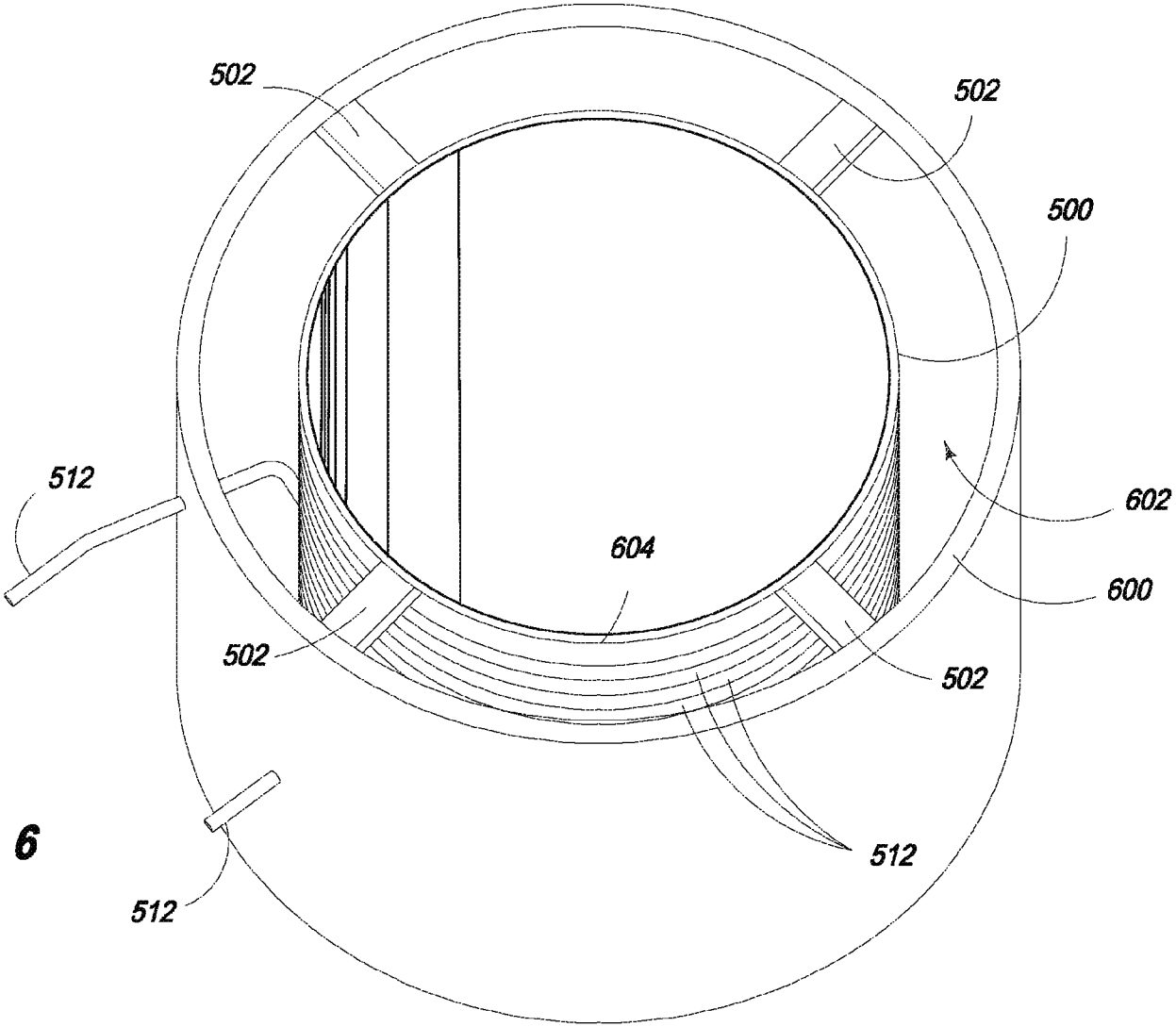

FIGS. 5 and 6 show side and front views of parts of a refrigeration system that may be used in refrigeration systems 400 or 450. A chamber 500 having a cylindrical shape is shown in FIGS. 5 and 6. Alternative suitable shapes include a cube, tetrahedron, or other shapes. Chamber 500 is stainless steel, but other metals or polymers might be used. Chamber 500 volume may be less than about 3 feet$^3$ (ft$^3$) for use in a consumer-oriented product or scaled up for commercial use. Bracket 502 on chamber 500 and support 510 may be used for mounting chamber 500 during manufacturing and/or in a cabinet for a freeze dryer.

A vacuum port 504 allows withdrawal of gases from chamber 500 and a drain port 508 allows withdrawal of liquids from chamber 500. A cable port 506 provides a passageway for access of wiring and/or sensors, such as sensor 352 shown in FIG. 3B. An evaporator coil 512 is shown coiled around chamber 500 prior to application of insulation.

FIG. 6 shows a wall 604 of chamber 500 through which vacuum port 504, cable port 506, and drain port 508 are formed. An insulation pad 600 positioned to surround wall 604 radially provides a gap 602 between insulation pad 600 and wall 604. Additional insulation (not shown) may be inserted into gap 602 and adhere in contact with an outer surface of wall 604. The additional insulation may also adhere in contact with insulation pad 600. The circular rear of chamber 500 may be insulated likewise. The additional insulation and insulation pad 600 may be closed-cell insulation and have a cumulative R value of at least 17. Such insulation may reduce exposure of wall 604 to ambient air compared to insulation not adhered in contact with the outer surface. Observation indicates that gaps between insulation and the outer surface of wall 604 that allow ambient air exposure also allow solid water to form thereon. Closed-cell insulation may also resist water absorption, which could reduce R value.

Due to the −50° F. or less temperature of the outer surface of wall 604 during operation of a refrigeration system in which it is included, solid water from ambient moisture outside chamber 500 may form on wall 604, if exposed, subsequently melt, and damage components of the refrigeration system. Spray-on expanding foam insulation is available in a closed-cell form and may be sprayed into gap 602 to provide the described structure. Spray-on foam may of itself adhere in contact with wall 604 without additional adhesive. It is conceivable that a combination of adhesive and insulation may instead be used to seal the outer surface of wall 604 from ambient exposure. Spray-on closed-cell foam may have an R value of about 7 per inch, producing R-17.5 when at least 2.5 inches.

Figure 7:
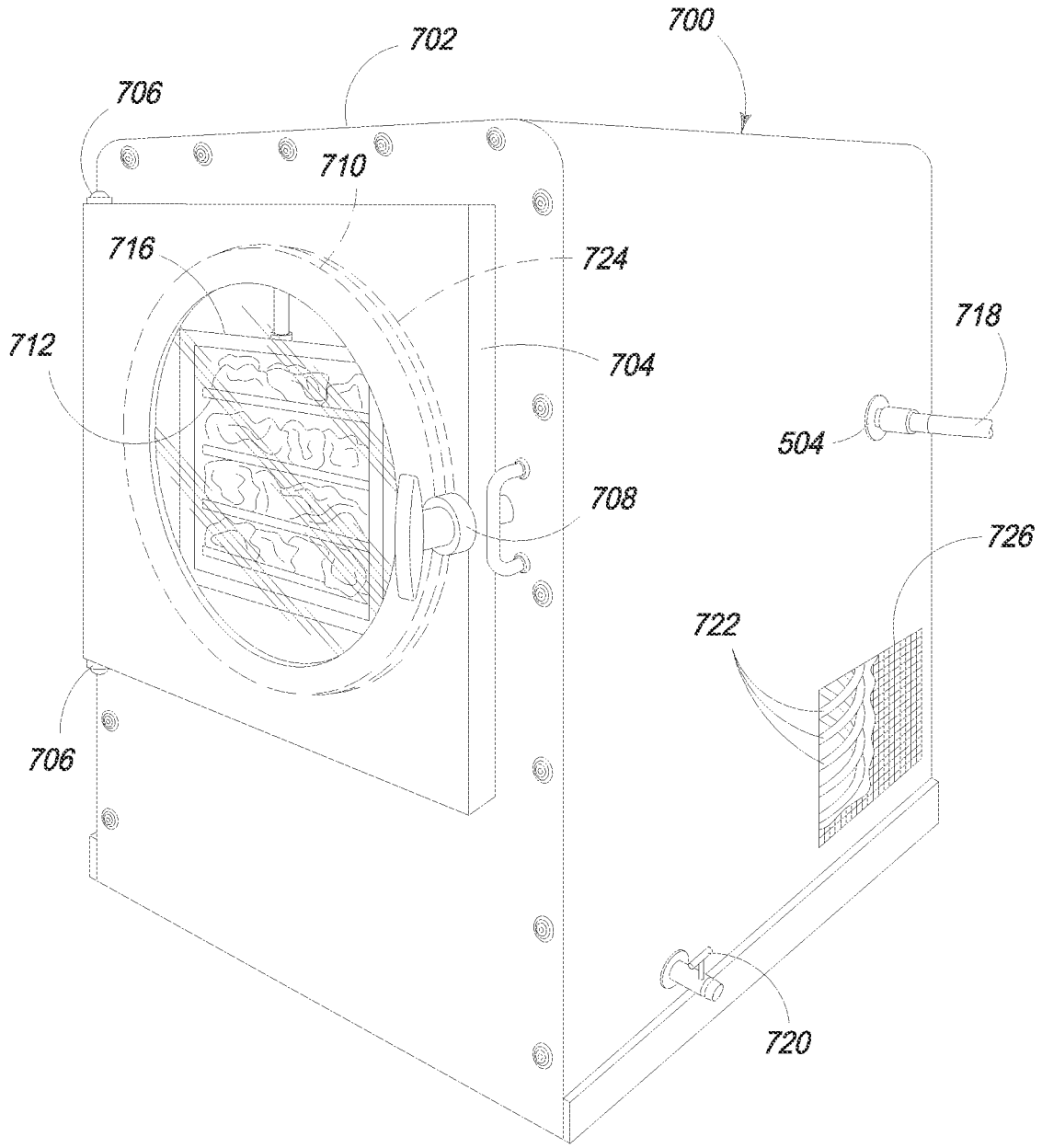
FIGS. 7 and 8 show perspective front and rear views of a freeze drying apparatus.
Figure 8:
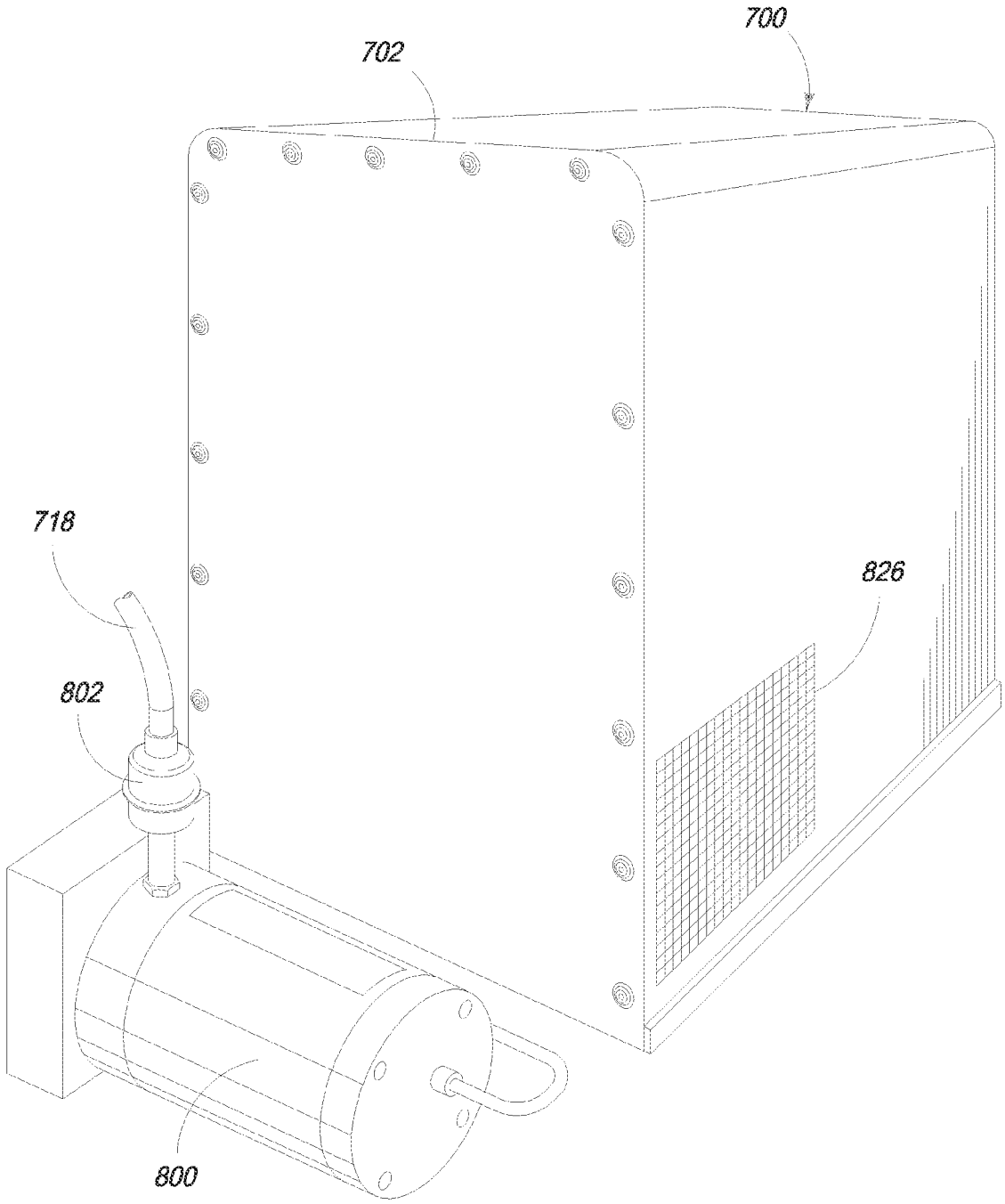

Chamber 500 may be used in a freeze dryer 700 shown in FIGS. 7 and 8. Freeze dryer 700 includes a cabinet 702 that houses a refrigeration system, such as refrigeration system 400 or 450. Hinges 706 on cabinet 702 attach a transparent door 704, allowing an operator to view material condition in chamber 500. Transparent door 704 may be acrylic. Metal or another non-transparent material may be used, though without the benefit of viewing the material in-process. A latch mechanism 708 allows securely closing door 704 so that a seal 710 seats against a front port 724 into chamber 500 inside cabinet 702. A vacuum generated by withdrawing gas through vacuum port 504 using a vacuum hose 718 may be maintained inside chamber 500 with seal 710 properly seated against front port 724. A drain valve 720 connected by a drain line to drain port 508 shown in FIG. 5 allows liquid draining as appropriate.

A refrigeration system in cabinet 702 may include a condenser coil 722 in operation similar to condenser coil 408 in refrigeration system 400 or 450. A portion of grating 726 is cut away in FIG. 7 to show condenser coil 722. Grating 726 in FIG. 7 and grating 826 in FIG. 8 allow cooling air flow through cabinet 702 either by natural convection or forced convection using a device such as fan 452 in refrigeration system 450 of FIG. 4B. FIG. 8 also shows a vacuum pump 800 and a filter 802 to reduce introduction of water or other contaminants into vacuum pump 800. All of a refrigeration system, such as refrigeration system 400 or 450, may be located inside cabinet 702. All of a vacuum system, such as vacuum system 300 or 350, may be located inside cabinet 702, though vacuum pump 800 is outside cabinet 702 as an option.

Reducing water introduction into vacuum pump 800 is also facilitated by the system design described herein. For example, shelves 712 are positioned in a shelf housing 716 in chamber 500. A heater, such as heater 304, may be attached to individual shelves to heat material placed on shelves 712 and to facilitate sublimation of solid water. Shelves 712 may be stainless steel, aluminum, copper, or another material suitable for heating. Examples of suitable heaters include infra-red heaters, microwave heaters, quartz heaters, and wire heater elements embedded in rubber sheets as heater blankets. As solid water changes phase to gaseous water, it flows out of shelf housing 716 and condenses on an inner surface of wall 604 of chamber 500 cooled to −50° F. or less, freezing in place. It is intended that water sublimated from freeze drying material transfers from the material to wall 604 without accumulating in vacuum pump 800.

As appreciated from FIGS. 3A, 3B, 6, and 7, shelves 712 may be positioned within chamber 500 such that the inner surface of wall 604 surrounds shelves 712 radially. Wall 604 and shelf housing 716 may further be concentric. With vacuum port 504 located at the rear of chamber 500, the gaseous water flows over the inner surface of wall 604, providing opportunity to condense and freeze before reaching vacuum port 504. Shelf housing 716 may enclose shelves 712 so that all gaseous water flows from the front of shelf housing 716, between door 704 and shelf housing 716, and into the portion of chamber 500 surrounding shelf housing 716. A flow pattern then proceeds around shelf housing 716 to vacuum port 504. The flow pattern may produce eddies as the flow changes direction around shelf housing 716 and increase opportunity for condensation. Such a configuration may be contrasted with known freeze dryers, such as described in U.S. Pat. Nos. 6,226,887 and 6,122,836 to Tenedini, U.S. Pat. No. 5,822,882 to Anger, and US Patent App. No. 2010/0018073 by Fissore. The known devices use separate process and condenser chambers and use additional condensing coils separate from a cooling system for the material being freeze dried.

Shelf housing 716 may be formed from polymer, plastic, polyethylene, polystyrene, composite material, fiberglass composite, or other insulating material to reduce radiant or other heat transfer from heaters on shelves 712 to solid water collected on the inner surface of wall 604 of chamber 500. Without shelf housing 716 shielding wall 604 from heaters on shelves 712, the solid water thus collected might sublimate again, enter vacuum hose 718, and accumulate in vacuum 800 if filter 802 is clogged or not present. Damage to or inefficient operation of vacuum pump 800 may result. Notably, freeze dryer 700 combines refrigeration system 450 and vacuum system 350 in a manner that allows pressure-activated heater cycling as well as reaching a temperature of −50° F. or less in the chamber with single-stage compression.

A temperature gradient may exist in chamber 500 at times. When freezing material on shelves 712 with the heater turned off, evaporator coil 404 may establish a substantially uniform chamber temperature. After reaching the first chamber temperature and activating the heater, a temperature of −50° F. or less may still exist in chamber 500 near wall 604, but temperature may be higher at shelves 712. After deactivating the heater, chamber temperature may tend to become more uniform. Nevertheless, a benefit of the embodiments herein includes operation without determining and controlling temperatures within chamber 500. Instead, pressure-activated heater cycling automatically produces desired freeze drying conditions. Such may be contrasted with U.S. Pat. No. 6,971,187 to Pikal that uses a complex series of steps measuring various temperatures and pressures during an experimental run to develop an optimized recipe for future freeze drying.

Accordingly, a freeze drying method includes decreasing pressure in a chamber to a first vacuum pressure, the chamber containing a material containing solid water. As a result of reaching the first pressure, a control system automatically activates a heater and heats the material without melting the solid water. The method includes sublimating the solid water and increasing pressure to a second vacuum pressure greater than the first pressure. As a result of reaching the second pressure, the control system automatically deactivates the heater and, as a result, repeats a decrease in pressure, pressure-activated heater activation, material heating, water sublimation, and increase in pressure and accomplishes pressure-activated heater cycling.

By way of example, the method may further include producing the decrease in pressure with a vacuum pump running continuously during the pressure-activated heater cycling. Such a method may be contrasted with U.S. Pat. Nos. 6,226,887 and 6,122,836 to Tenedini, wherein vacuum pumps are cycled off and on to regulate pressure. A decrease in pressure, pressure-activated heater activation, material heating, water sublimation, and increase in pressure may be automatically repeated until a run time after an immediately preceding pressure-activated heater activation exceeds at least about 2 hours without pressure-activated heater deactivation. The run time may exceed 6 hours. After the run time exceeds at least about 2 hours, the material may be removed in a freeze dried condition from the chamber, the removed material exhibiting a water content of less than about 4 weight percent. As a result of the run time exceeding at least about 2 hours, the control system may automatically deactivate the heater and, as a result, repeat a decrease in pressure to the first vacuum pressure or less followed by deactivating a vacuum pump and removing the material in a freeze dried condition from the chamber.

A first pressure of from about 50 to about 400 milliTorr (mTorr) may be selected in the control system. A second pressure of from about 55 to about 1,000 mTorr, such as from about 250 to about 1,000 mTorr, may be selected in the control system. More specifically, first and second pressures of about 300 and about 350 mTorr, respectively, may be selected in the control system. Selection of the first and second pressures may vary depending on the volume of the chamber and the flow rating of the vacuum pump. The 300 and 350 mTorr settings were suitable for a 2.65 $ft^3$ chamber and two-stage, 3.0 $ft^3$ per minute (CFM) vacuum pump. Vacuum pumps providing higher cubic feet per minute flow capabilities may also be used with corresponding adjustments to vacuum pressure settings to compensate for the increased removal of sublimated solid water. As an option, process controls could be made accessible to the operator to select the first pressure, second pressure, and completion (vacuum pump shut-off) pressure. However, process controls may be factory pre-set consistent with the benefits of automated operation for most consumers.

The method may include selecting the first and second pressures in the control system before starting the freeze drying method and maintaining them during the pressure-activated heater cycling. Instead, the method may include selecting the first and second pressures in the control system before starting the freeze drying method and dynamically adjusting them during the pressure-activated heater cycling. The adjustment may be based at least on a run time after an immediately preceding pressure-activated heater activation. Dynamically adjusting the first and second pressures may include decreasing a set point for the first pressure and increasing a set point for the second pressure. Alternatively, dynamically adjusting the first and second pressures may include maintaining a difference between the first and second pressures while increasing both a set point for the first pressure and a set point for the second pressure or while decreasing both a set point for the first pressure and a set point for the second pressure.

The method may further include relying solely on pressure in the chamber and the run time after an immediately preceding pressure-activated heater activation to determine completion of freeze drying. The material may be on a tray and the control system may automatically control a tray temperature to about 125° F. or less.

Another freeze drying method may include decreasing pressure in a chamber to a vacuum pressure, the chamber containing a material containing solid water. A temperature in the chamber is decreased to −50° F. or less using a refrigeration system with single-stage compression. The method includes sublimating the solid water.

By way of example, sublimating the solid water may include pressure-activated heater cycling, such as described herein. Closed-cell insulation having an R value of at least 17 may adhere in contact with an outer surface of at least one wall of the chamber and reduce exposure of the outer surface to ambient air. The closed-cell insulation may include cured, expanded foam spray enclosing the outer surface of the at least one wall, such as, the entire outer surface. A refrigerant in the refrigeration system may exhibit a vapor pressure at −50° F. of at least about 14.7 psi absolute and a vapor pressure differential between −55° F. and 100° F. of at least 230 psi, such as at least 300 psi. The method may include flowing condensed refrigerant in the refrigeration system through a capillary tube having a length of at least 30 inches, such as 30 to 70 inches, the length and an inside diameter of the capillary tube enabling an evaporated refrigerant pressure of at least 14.7 psi absolute at a suction line to the single-stage compression. Nominal inside diameter of the capillary tube may be at least 0.024 inches.

A freeze drying apparatus includes a chamber, a vacuum pump operable to decrease pressure in the chamber to a first vacuum pressure, and a heater operable to heat material containing solid water in the chamber. A control system is included that is programmed with instructions operable to automatically activate the heater at the first pressure, to allow heating the material without melting the solid water, to allow sublimating the solid water, to automatically deactivate the heater at a second vacuum pressure greater than the first pressure, and to accomplish pressure-activated heater cycling.

By way of example the apparatus may further include closed-cell insulation, a refrigerant, a capillary tube, and a single-stage compressor. The insulation may have an R value of at least 17 and be adhered in contact with an outer surface of a wall of the chamber. The refrigerant may be in a refrigeration system and exhibit a vapor pressure at −50° F. of at least 14.7 psi absolute and a vapor pressure differential between −55° F. and 100° F. of at least 230 psi, such as at least 300 psi. The capillary tube may be in the refrigeration system and have a length of at least 30 inches, the length and an inside diameter of the capillary tube being operable to provide an evaporated refrigerant pressure of at least 14.7 psi absolute at a suction line to single-stage compression.

EXAMPLE

An "intelligent" freeze dryer with an internal vacuum chamber volume of 2.65 $ft^3$ was constructed such as shown in FIGS. 3B, 4B, and 5-8 that removed the water content of any one or combinations of a large variety of fruits, vegetables, meats and prepared foods as individual ingredients or a combination of food ingredients. The vacuum chamber was made of stainless steel wrapped with copper tubing for refrigeration system evaporator coils and insulated with 2.5 inches of foam-in-place insulation (closed cell). The refrigeration system condenser was ⅓ horsepower and was brazed to the evaporator copper coils surrounding the vacuum chamber. The freeze dryer used a process of sublimation that combined freezing and vacuum drying of the materials in a self-controlled process including pressure-activated heater cycling.

Items were prepared for drying, loaded into the vacuum chamber of the freeze dryer on heatable shelves, the door was closed, and the freeze dryer started by an operator pressing a single button. The moisture removal process was controlled by the freeze dryer without selection by the operator of a temperature or pressure profile or otherwise determining how to remove the moisture for a certain material.

The freeze dryer froze the material to less than −35° F., often reaching a chamber temperature of −50° F. The freeze dryer turned on a two-stage, 3.0 CFM vacuum pump, reduced pressure in the chamber to a first pressure, and then added heat to the material during the vacuum process. A 6.0 and 8.0 CFM vacuum pump were also used. A control system operated by a processor on a circuit board controlled the freezing system, vacuum system, and heater to accomplish pressure-activated heater cycling. A pressure-activated control turned the heaters on and off at respective first and second pressure set points in a manner designed to add heat to the material to promote sublimation without overwhelming the vacuum system. Heater thermostats were set to 125° F. maximum temperature. Freeze drying was complete after: 1) the pressure-activated control was in a "heater-activated" state for more than 2 hours and 2) the heater was then turned off and chamber pressure was reduced to a pressure lower than the heater activation pressure. When the material was dried, the freeze dryer sounded a buzzer and turned on a light to alert the user that the material was ready to be removed and stored for future use.

Ice cream sandwiches were found to be the most difficult to process of the many foods successfully freeze dried. The ice cream sandwiches were removed from a residential freezer maintained at about −7° F. and the paper wrapping of the sandwich was sliced open with a razor blade to allow sublimating solid water to exit the wrapper. 72 sandwiches fit on the heatable shelves without being stacked directly on top of each other. Four shelves of 18 sandwiches were in place. The refrigeration system was the first apparatus powered by the circuit board after pressing the start button. The ice cream sandwiches were frozen for 12 hours. While the chamber reached a temperature of −50° F., the sandwich temperature reached −39° F. at the end of the 12 hours.

When the freeze cycle was complete, the vacuum pump activated and reduced pressure in the chamber to about 300 mTorr over a period of 1 hour. The pressure control on the circuit board (connected via wires to a pressure transducer in communication with the vacuum chamber) activated the shelf heaters under and above the ice cream sandwiches. As sublimation increased, pressure in the chamber rose to 350 mTorr and a pressure control on the circuit board deactivated the heaters. The pressure in the chamber continued to rise slightly above the 350 mTorr pressure and then dropped gradually back to 300 mTorr. Reaching 300 mTorr activated the heaters and the process of sublimation continued.

Gaseous water from the sublimation process condensed and froze to the side walls of the vacuum chamber, near the rear of the vacuum chamber near the vacuum port. During sublimation these ice blocks grew substantially and were located away from the heatable shelves containing the ice cream sandwiches. After about 24 cycles of heater activation/deactivation covering a time period of 13 hours, the heaters were activated but sublimation was unable to generate enough gaseous water to cause a pressure rise sufficient to deactivate the heaters. After the heaters were activated for a period of 6 continuous hours after this final heater activation, the controls deactivated the heaters and the vacuum pump. It was noted that the final vacuum pressure reading before the heaters were deactivated was 160 mTorr. The condenser remained activated and the only pressure loss in the system was gradual through the vacuum pump.

Figure 9:
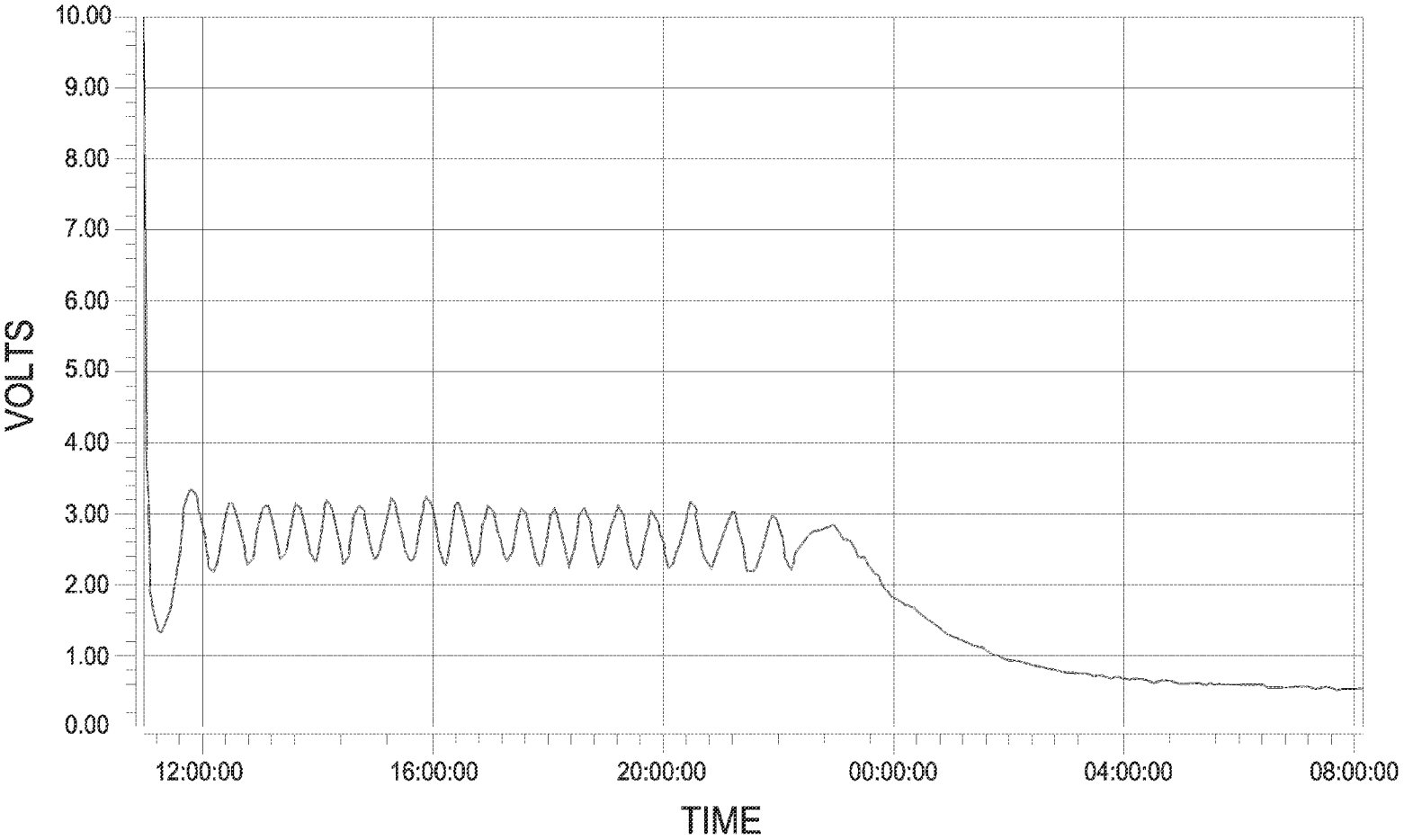
FIG. 9 is a graph showing pressure fluctuations resulting from pressure-activated heater cycling.

FIG. 9 shows a graph of the voltage signal from a transducer measuring pressure in the chamber over time. FIG. 9 was obtained using an 8.0 CFM vacuum pump, so 19 heater cycles were sufficient. Otherwise, FIG. 9 is similar to observations using the 3.0 CFM vacuum pump yielding 24 cycles, except that heater cycles also tend to be longer with lower vacuum flow rate.

The sandwiches were removed from the vacuum chamber, inspected for dryness and weighed. It was noted that the sandwiches retained their color, size, and appearance. Several sandwiches were weighed and then dried further in a convection oven at elevated temperatures for several hours to remove any further moisture. The dried sandwiches were weighed after drying in the convection oven and found to be about 98% of their original weight. This secondary drying only removed an additional 2% moisture and some of that may have resulted from instantaneous rehydration upon exposure to ambient air humidity. The sandwiches were also cut in pieces after removal from the freeze dryer in order to examine thoroughness of drying and they appeared very, very dry. They became powder easily.

Other food items including lasagna, blue berries, corn, green beans, black berries, yogurt, cherries, ice pops, smoothies, tomatoes, baked beans, shredded pork, shredded beef, beef steaks, chicken chunks, pineapple, kiwi fruit, papaya, mango strips, gelatin dessert, and many other foods were successfully freeze dried using the same process described in this Example. Differences in performance, such as the number of cycles to completion, were observed among the different food types, but all of the foods maintained their shape, color, texture, taste and odor. Various combinations of foods were freeze dried together using the process in this Example to evaluate impact on food quality. No impacts were found. Rehydration was quick, requiring just a few minutes of exposure to water. Food taste, texture, and color of rehydrated foods were very near the "before freeze dried" condition.

In compliance with the statute, the embodiments have been described in language more or less specific as to structural and methodical features. It is to be understood, however, that the embodiments are not limited to the specific features shown and described. The embodiments are, therefore, claimed in any of their forms or modifications within the proper scope of the appended claims appropriately interpreted in accordance with the doctrine of equivalents.

TABLE OF REFERENCE NUMERALS FOR FIGS

100 method
102 action system
104 action
106 action
108 decision
110 decision
112 action
200 method
202 action
204 action
206 action
208 decision
210 decision
212 action
214 action
216 action
218 action
300 vacuum system
302 chamber
304 heater
306 heater signal
308 controller
310 processor
312 pressure signal
314 vacuum pump
316 pump signal
318 vacuum line
350 vacuum system
352 sensor
354 pressure signal
356 tee
358 drain line
360 drain valve
400 refrigeration system
402 insulation
404 evaporator coil
406 compressor
408 condenser coil
410 capillary tube
412 flow direction
450 refrigeration system
452 fan
454 dryer filter
460 capillary tube
462 flow direction
500 chamber
502 brackets
504 vacuum port
506 cable port
508 drain port
510 support
512 evaporator coil
600 insulation pad
602 gap
604 wall
700 freeze dryer
702 cabinet
704 door
706 hinge
708 latch mechanism
710 seal
712 shelves
716 shelf housing
718 vacuum hose
720 drain valve
722 condenser coil
724 front port
726 grating
800 vacuum pump
802 filter
826 grating

What is claimed is:

1. A freeze drying method comprising:

decreasing pressure in a chamber to a first vacuum pressure, the chamber containing a material containing solid water;

as a result of reaching the first vacuum pressure, a control system automatically activating a heater and heating the material without melting the solid water;

sublimating the solid water to gaseous water and increasing pressure to a second vacuum pressure greater than the first vacuum pressure;

cooling an interior surface of the chamber to below the material temperature;

condensing and freezing at least a portion of the gaseous water on the interior surface of the chamber; and as a result of reaching the second vacuum pressure, the control system automatically deactivating the heater and, as a result, repeating a decrease in pressure to the first vacuum pressure, pressure-activated heater activation as a result of reaching the first vacuum pressure, material heating, water sublimation, and increase in pressure to the second vacuum pressure and accomplishing pressure-activated heater cycling.

2. The method of claim 1 further comprising producing the decrease in pressure with a vacuum pump running continuously during the pressure-activated heater cycling.

3. The method of claim 1 further comprising closed-cell insulation having an R value of at least 17 adhering in contact with an outer surface of at least one wall of the chamber and reducing exposure of the outer surface to ambient air.

4. The method of claim 3 wherein the closed-cell insulation comprises cured, expanded foam spray enclosing the outer surface of the at least one wall.

5. The method of claim 1 further comprising relying solely on pressure in the chamber and a run time after an immediately preceding pressure-activated heater activation to determine completion of freeze drying.

6. The method of claim 1 further comprising decreasing a temperature in the chamber to −50° F. or less using a refrigeration system with single-stage compression.

7. The method of claim 1 wherein the material is on a tray and further comprising the control system automatically controlling a tray temperature to 125° F. or less.

8. A freeze drying method comprising:

decreasing pressure in a chamber to a first vacuum pressure, the chamber containing a material containing solid water;

as a result of reaching the first vacuum pressure, a control system automatically activating a heater and heating the material without melting the solid water;

sublimating the solid water and increasing pressure to a second vacuum pressure greater than the first vacuum pressure;

as a result of reaching the second vacuum pressure, the control system automatically deactivating the heater and, as a result, repeating a decrease in pressure to the first vacuum pressure, pressure-activated heater activation as a result of reaching the first vacuum pressure, material heating, water sublimation, and increase in pressure and accomplishing pressure-activated heater cycling; and automatically repeating a decrease in pressure, pressure-activated heater activation, material heating, water sublimation, and increase in pressure until a run time after an immediately preceding pressure-activated heater activation exceeds at least 2 hours without pressure-activated heater deactivation.

9. The method of claim 8 further comprising, after the run time exceeds at least 2 hours, removing the material in a freeze dried condition from the chamber, the removed material exhibiting a water content of less than 4 weight percent.

10. The method of claim 8 further comprising, as a result of the run time exceeding at least 2 hours, the control system automatically deactivating the heater and, as a result, decreasing pressure to the first vacuum pressure or less followed by deactivating a vacuum pump and removing the material in a freeze dried condition from the chamber.

11. The method claim 8 further comprising, after the run time exceeds 6, removing the material in a freeze dried condition from the chamber, the removed material exhibiting a water content of less than 4 weight percent.

12. The method of claim 8 wherein the first and second vacuum pressures of 50 to 400 mTorr and 55 to 1,000 mTorr, respectively, are selected in the control system.

13. The method of claim 8 wherein the first and second vacuum pressures are selected in the control system before starting the freeze drying method and maintained during the pressure-activated heater cycling.

14. A freeze drying method comprising:

decreasing pressure in a chamber to a first vacuum pressure, the chamber containing a material containing solid water;

as a result of reaching the first vacuum pressure, a control system automatically activating a heater and heating the material without melting the solid water;

sublimating the solid water and increasing pressure to a second vacuum pressure greater than the first vacuum pressure, the first and second vacuum pressures being selected in the control system before starting the freeze drying method;

as a result of reaching the second vacuum pressure, the control system automatically deactivating the heater and, as a result, repeating a decrease in pressure to the first vacuum pressure, pressure-activated heater activation as a result of reaching the first vacuum pressure, material heating, water sublimation, and increase in pressure and accomplishing pressure-activated heater cycling; and dynamically adjusting the first and second vacuum pressures during the pressure-activated heater cycling based at least on a run time after an immediately preceding pressure-activated heater activation.

15. The method of claim 14 wherein dynamically adjusting the first and second vacuum pressures comprises decreasing a set point for the first vacuum pressure and increasing a set point for the second vacuum pressure.

16. The method of claim 14 wherein dynamically adjusting the first and second vacuum pressures comprises maintaining a difference between the first and second vacuum pressures while increasing both a set point for the first vacuum pressure and a set point for the second vacuum pressure or while decreasing both a set point for the first vacuum pressure and a set point for the second vacuum pressure.

17. A freeze drying method comprising:

closed-cell insulation having an R value of at least 17 adhering in contact with an outer surface of at least one wall of a chamber and reducing exposure of the outer surface to ambient air;

using a refrigerant in a refrigeration system exhibiting a vapor pressure at −50° F. of at least 14.7 pounds per inch (psi) absolute and a vapor pressure differential between −55° F. and 100° F. of at least 230 psi;

flowing condensed refrigerant in the refrigeration system through a capillary tube having a length of at least 30 inches, the length and an inside diameter of the capillary tube enabling an evaporated refrigerant pressure of at least 14.7 psi absolute at a suction line to single-stage compression;

decreasing a temperature in the chamber to −35° F. or less using the refrigeration system with single-stage compression;

decreasing pressure in the chamber to a first vacuum pressure, the chamber containing a material containing solid water;

as a result of reaching the first vacuum pressure, a control system automatically activating a heater and heating the material without melting the solid water;

sublimating the solid water and increasing pressure to a second vacuum pressure greater than the first vacuum pressure;

as a result of reaching the second vacuum pressure, the control system automatically deactivating the heater and, as a result, repeating a decrease in pressure, pressure-activated heater activation, material heating, water sublimation, and increase in pressure and accomplishing pressure-activated heater cycling, a vacuum pump producing the decrease in pressure and running continuously during the pressure-activated heater cycling;

automatically repeating a decrease in pressure, pressure-activated heater activation, material heating, water sublimation, and increase in pressure until a run time after an immediately preceding pressure-activated heater activation exceeds at least 2 hours without pressure-activated heater deactivation; and after the run time exceeds at least 2 hours, removing the material in a freeze dried condition from the chamber, the removed material exhibiting a water content of less than 4 weight percent.

18. The method of claim 17 further comprising relying solely on pressure in the chamber and run time after an immediately preceding pressure-activated heater activation to determine completion of freeze drying.

19. The method of claim 17 wherein decreasing the temperature to −35° F. or less comprises decreasing the temperature to −50° F. or less.

* * * * *